US011037722B2

(12) United States Patent
Jung et al.

(10) Patent No.: US 11,037,722 B2
(45) Date of Patent: Jun. 15, 2021

(54) COIL COMPONENT AND METHOD OF MANUFACTURING THE SAME

(71) Applicant: SAMSUNG ELECTRO-MECHANICS CO., LTD., Suwon-si (KR)

(72) Inventors: Ji Hyung Jung, Suwon-si (KR); Boum Seock Kim, Suwon-si (KR); Byeong Cheol Moon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 303 days.

(21) Appl. No.: 15/970,192

(22) Filed: May 3, 2018

(65) Prior Publication Data

US 2019/0088407 A1 Mar. 21, 2019

(30) Foreign Application Priority Data

Sep. 20, 2017 (KR) ..... 10-2017-0121212

(51) Int. Cl.
*H01F 17/00* (2006.01)
*H01F 41/00* (2006.01)
(Continued)

(52) U.S. Cl.
CPC ..... *H01F 27/292* (2013.01); *H01F 17/0013* (2013.01); *H01F 17/0033* (2013.01);
(Continued)

(58) Field of Classification Search
CPC ..... H01F 17/0013; H01F 2017/002; H01F 41/041
See application file for complete search history.

(56) References Cited

U.S. PATENT DOCUMENTS 7,872,844 B2 * 1/2011 Yoneda ..... H01T 4/12 361/120
2002/0008606 A1 * 1/2002 Okuyama ..... H01F 41/043 336/200

(Continued)

FOREIGN PATENT DOCUMENTS

JP 3788074 B2 6/2006
JP 2007-067214 A 3/2007

(Continued)

OTHER PUBLICATIONS

Notice of Office Action issued in Korean Patent Application No. 10-2017-0121212, dated Sep. 17, 2018; with English translation.

*Primary Examiner* — Elvin G Enad
*Assistant Examiner* — Malcolm Barnes
(74) *Attorney, Agent, or Firm* — Morgan, Lewis & Bockius LLP

(57) ABSTRACT

A coil component includes: a body portion; a coil portion; and an electrode portion, wherein the coil portion includes: a support member; a first coil layer disposed on a first surface of the support member, having first conductive patterns having a planar coil shape, and having a constant line width up to an innermost end portion; a second coil layer disposed on a second surface of the support member, having second conductive patterns having a planar coil shape, and having a constant line width up to an innermost end portion; a via hole penetrating through the support member and partially overlapping innermost end portions of the first and second conductive patterns; and a via conductor filling a portion of the via hole and connected to the innermost end portions of the first and second conductive patterns.

13 Claims, 14 Drawing Sheets

(51) Int. Cl.

| | |
|---|---|
| ***H01F 27/29*** | (2006.01) |
| ***H01F 41/04*** | (2006.01) |
| ***H01F 41/10*** | (2006.01) |
| ***H01F 17/04*** | (2006.01) |
| ***H01F 27/28*** | (2006.01) |

(52) U.S. Cl.
CPC ..... *H01F 17/04* (2013.01); *H01F 27/2804* (2013.01); *H01F 41/046* (2013.01); *H01F 41/10* (2013.01); *H01F 2017/048* (2013.01)

(56) References Cited

U.S. PATENT DOCUMENTS

2007/0181994 A1* 8/2007 Fukase ..... H05K 3/061 257/700
2007/0257761 A1* 11/2007 Mano ..... H01F 41/046 336/200
2013/0113595 A1* 5/2013 Otsubo ..... H01F 17/0013 336/200
2014/0034373 A1* 2/2014 Yoshikawa ..... H05K 1/165 174/260
2014/0145815 A1* 5/2014 Ishii ..... H01F 27/292 336/200
2014/0266546 A1* 9/2014 Mao ..... H01F 41/046 336/200
2014/0285304 A1 9/2014 Yoo et al.
2014/0368091 A1* 12/2014 Kim ..... H01L 41/293 310/364
2015/0102889 A1* 4/2015 Choi ..... H01F 17/0013 336/200
2015/0302975 A1* 10/2015 Qi ..... H01F 17/0013 336/200
2016/0049234 A1* 2/2016 Kawashima ..... H01F 17/0013 336/200
2016/0086720 A1* 3/2016 Jeong ..... H01F 17/0013 336/200
2016/0163438 A1* 6/2016 Moon ..... H01F 27/292 336/212
2017/0178789 A1 6/2017 Kim et al.
2017/0229963 A1* 8/2017 Zeng ..... H03H 1/0007
2018/0096783 A1* 4/2018 Fukuda ..... H01F 17/04
2019/0035527 A1* 1/2019 Okura ..... H01F 5/04
2019/0333673 A1* 10/2019 Oomori ..... H01F 19/00

FOREIGN PATENT DOCUMENTS

KR 10-1451503 B1 10/2014
KR 10-2017-0073167 A 6/2017

* cited by examiner

COIL COMPONENT AND METHOD OF MANUFACTURING THE SAME

CROSS-REFERENCE TO RELATED APPLICATION(S)

This application is based on and claims the benefit of priority to Korean Patent Application No. 10-2017-0121212 filed on Sep. 20, 2017 in the Korean Intellectual Property Office, the entire disclosure of which is incorporated herein by reference.

TECHNICAL FIELD

The present disclosure relates to a coil component and a method of manufacturing the same.

BACKGROUND

Recently, in accordance with the development of mobile wireless communications devices and wearable devices, components having excellent functionality and which are slim and light have been demanded. Particularly, the latest portable smartphones and wearable devices have used a high frequency, and it has been required to stably supply power in a use frequency region of the portable smartphones and wearable devices. Therefore, in accordance with the development of smartphones and the wearable devices, it has been gradually demanded that a power inductor having a function of suppressing a rapid change in a current in a power supply terminal may be used at a high frequency and a high current. In addition, a thin film high frequency inductor has been used as a noise filter in a signal terminal of a high frequency circuit.

Meanwhile, a via for electrical conduction between coil layers is formed in a thin film power inductor. In this case, via pads having a size greater than that of the via are formed on the coil layers in order to secure alignment between the via and a coil. However, a problem such as overplating has often occurred due to the via pads having greater widths than line widths of coil patterns.

SUMMARY

An aspect of the present disclosure may provide a coil component in which plating thickness dispersion may be suppressed and uniformity of a plating thickness may be secured by preventing overplating, and direct current (DC) resistance characteristics (Rdc) may be improved by increasing contact areas between a via conductor and conductive patterns, and a method of manufacturing the same.

According to an aspect of the present disclosure, a coil component may be provided, in which via pads are not formed on end portions of innermost peripheral portions of conductive patterns of coil layers connected to a via conductor. In this case, a via hole in which the via conductor is formed may have a diameter equal to or greater than a line width of the end portions of the innermost peripheral portions of the conductive patterns, and the via conductor may be formed along walls of the via hole to fill a portion of the via hole rather than the entirety of the via hole.

According to an aspect of the present disclosure, a coil component may include: a body portion including a magnetic material; a coil portion disposed in the body portion; and an electrode portion disposed on the body portion and electrically connected to the coil portion, wherein the coil portion includes: a support member; a first coil layer disposed on a first surface of the support member in a stacking direction, having first conductive patterns having a planar coil shape, and having a constant line width up to an innermost end portion of the first conductive patterns; a second coil layer disposed on a second surface of the support member in the stacking direction, having second conductive patterns having a planar coil shape, and having a constant line width up to an innermost end portion of the second conductive patterns; a via hole penetrating through the support member and partially overlapping innermost end portions of the first and second conductive patterns; and a via conductor filling a portion of the via hole and connecting the innermost end portions of the first and second conductive patterns to each other.

According to another aspect of the present disclosure, a method of manufacturing a coil component may include: forming a coil portion; forming a body portion embedding the coil portion therein; and forming an electrode portion on the body portion, the electrode portion being electrically connected to the coil portion, wherein the forming of the coil portion includes: preparing a support member; forming a via hole penetrating through the support member; forming first and second partition walls on first and second surfaces of the support member, respectively, the first and second partition walls having openings of a planar coil shape; forming first and second coil layers on the first and second surfaces of the support member in a stacking direction, respectively, by filling the openings of the first and second partition walls with conductors, the first and second coil layers having, respectively, first and second conductive patterns having a coil shape and having innermost end portions partially overlapping the via hole, wherein each of the first and second conductive patterns has a constant line width up to the innermost end portions; forming a via conductor filling a portion of the via hole and connecting the innermost end portions of the first and second conductive patterns to each other; and removing the first and second partition walls.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
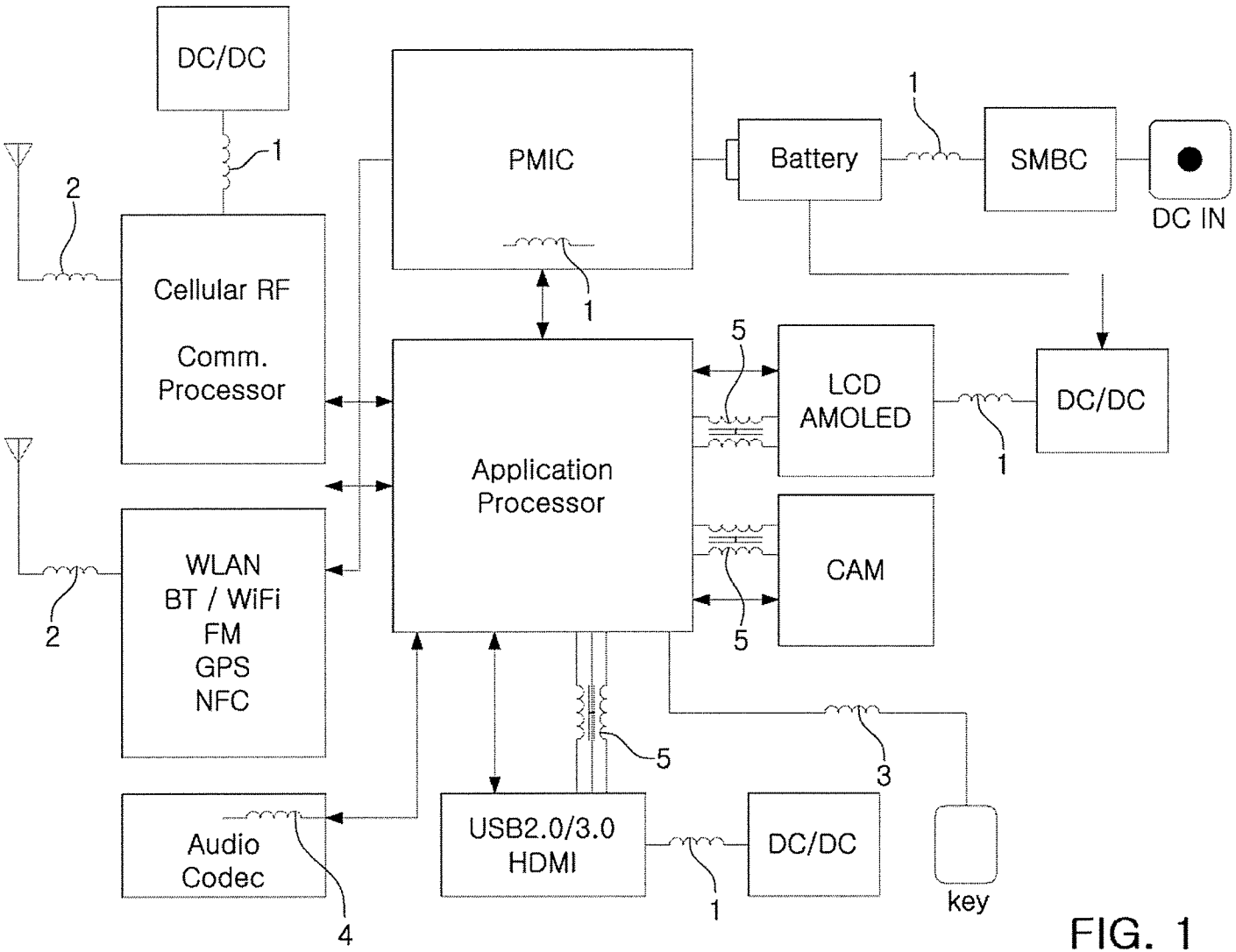
FIG. 1 is a schematic view illustrating an example of a coil component used in an electronic device.

Hereinafter, exemplary embodiments in the present disclosure will be described in more detail with reference to the accompanying drawings. In the drawings, shapes, sizes, and the like, of components may be exaggerated for clarity.

Meanwhile, herein, "electrically connected" conceptually includes a physical connection and a physical disconnection. It can be understood that when an element is referred to with terms such as "first" and "second", the element is not limited thereby. They may be used only for a purpose of distinguishing the element from the other elements, and may not limit the sequence or importance of the elements. In some cases, a first element may be referred to as a second element without departing from the scope of the claims set forth herein. Similarly, a second element may also be referred to as a first element.

In addition, the term "an exemplary embodiment" used herein does not refer to the same exemplary embodiment, and is provided to emphasize a particular feature or characteristic different from that of another exemplary embodiment. However, exemplary embodiments provided herein are considered to be able to be implemented by being combined in whole or in part one with one another. For example, one element described in a particular exemplary embodiment, even if it is not described in another exemplary embodiment, may be understood as a description related to another exemplary embodiment, unless an opposite or contradictory description is provided therein.

In addition, terms used herein are used only in order to describe an exemplary embodiment rather than limiting the present disclosure. In this case, singular forms include plural forms unless interpreted otherwise in context.

Electronic Device

FIG. 1 is a schematic view illustrating an example of a coil component used in an electronic device.

Referring to FIG. 1, it may be appreciated that various kinds of electronic components are used in an electronic device. For example, an application processor, a direct current (DC) to DC converter, a communications processor, a wireless local area network Bluetooth (WLAN BT)/wireless fidelity frequency modulation global positioning system near field communications (WiFi FM GPS NFC), a power management integrated circuit (PMIC), a battery, a SMBC, a liquid crystal display active matrix organic light emitting diode (LCD AMOLED), an audio codec, a universal serial bus (USE) 2.0/3.0 a high definition multimedia interface (HDMI), a CAM, and the like, may be used. In this case, various kinds of coil components may be appropriately used between these electronic components depending on their purposes in order to remove noise, or the like. For example, a power inductor 1, high frequency (HF) inductors 2, a general bead 3, a bead 4 for a high frequency (GHz), common mode filters 5, and the like, may be used.

In detail, the power inductor 1 may be used to store electricity in a magnetic field form to maintain an output voltage, thereby stabilizing power. In addition, the high frequency (HF) inductor 2 may be used to perform impedance matching to secure a required frequency or cut off noise and an alternating current (AC) component. Further, the general bead 3 may be used to remove noise of power and signal lines or remove a high frequency ripple. Further, the bead 4 for a high frequency (GHz) may be used to remove high frequency noise of a signal line and a power line related to an audio. Further, the common mode filter 5 may be used to pass a current therethrough in a differential mode and remove only common mode noise.

An electronic device may be typically a smartphone, but is not limited thereto. The electronic device may also be, for example, a personal digital assistant, a digital video camera, a digital still camera, a network system, a computer, a monitor, a television, a video game, or a smartwatch. The electronic device may also be various other electronic devices well-known in those skilled in the art, in addition to the devices described above.

Coil Component

Hereinafter, a coil component according to the present disclosure, particularly, a thin film type power inductor or a high frequency inductor will be described for convenience. However, the coil component according to the present disclosure may also be applied to the coil components for various purposes as described above. Meanwhile, herein, an upper surface is used to refer to any surface of any target component disposed in a direction that becomes distant from a support member in a third direction for convenience, and a lower surface is used to refer to any surface of any target component disposed in a direction toward the support member in the third direction for convenience. In addition, a side surface is used to refer to any surface of a target component disposed in any one of a first direction and a second direction for convenience. However, these directions are defined for convenience of explanation, and the claims are not particularly limited by the directions defined as described above.

Figure 2:
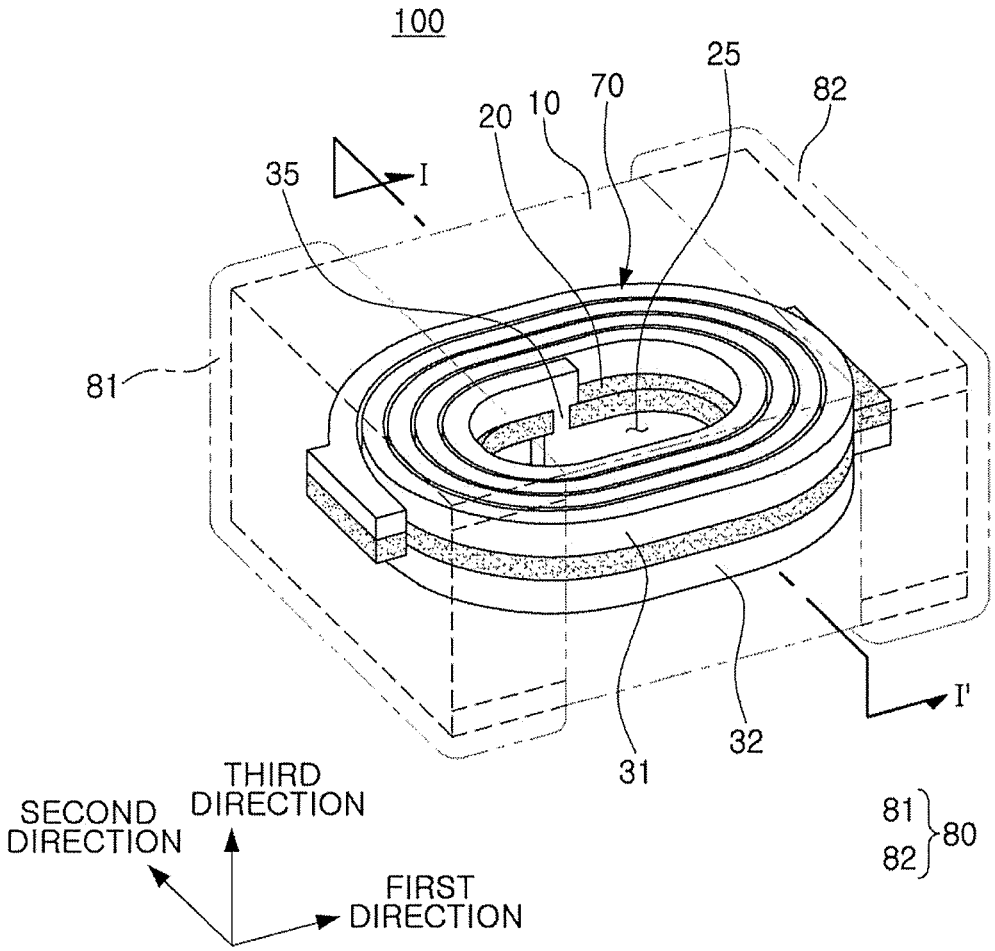
FIG. 2 is a schematic perspective view illustrating an example of a coil component.

FIG. 2 is a schematic perspective view illustrating an example of a coil component.

Referring to FIG. 2, a coil component 100 according to an exemplary embodiment in the present disclosure may include a body portion 10, a coil portion 70 disposed in the body portion 10, and an electrode portion 80 disposed on the body portion 10. The coil portion 70 may include a support member 20, a first coil layer 31 and a second coil layer 32 disposed on upper and lower surfaces of the support member 20, respectively, and a via conductor 35 penetrating through the support member 20 and connecting the first coil layer 31 and the second coil layer 32 to each other. The electrode portion 80 may include a first electrode 81 and a second electrode 82 disposed on the body portion 10 to be spaced apart from each other.

The body portion 10 may form an appearance of the coil component 100, and may have first and second surfaces opposing each other in the first direction, third and fourth surfaces opposing each other in the second direction, and fifth and sixth surfaces opposing each other in the third direction. The body portion 10 may have a hexahedral shape. However, a shape of the body portion 10 is not limited thereto. The body portion 10 may include a magnetic material having a magnetic property. For example, the body portion 10 may be formed by filling ferrite or metal magnetic particles in a resin. The ferrite may be a material such as Mn—Zn based ferrite, Ni—Zn based ferrite, Ni—Zn—Cu based ferrite, Mn—Mg based ferrite, Ba based ferrite, Li based ferrite, or the like. The metal magnetic particle may include one or more selected from the group consisting of iron (Fe), silicon (Si), chromium (Cr), aluminum (Al), and nickel (Ni). For example, the metal magnetic particle may be a Fe—Si—B—Cr based amorphous metal, but is not necessarily limited thereto. The metal magnetic particle may have a diameter of about 0.1 μm to 30 μm. The body portion 10 may have a form in which the ferrite or the metal magnetic particles are dispersed in a thermosetting resin such as an epoxy resin, a polyimide resin, or the like.

The magnetic material of the body portion 10 may be a magnetic material-resin composite in which metal magnetic powders and a resin mixture are mixed with each other. The metal magnetic powders may include iron (Fe), chromium (Cr), or silicon (Si) as a main component. For example, the metal magnetic powders may include iron (Fe)-nickel (Ni), iron (Fe), iron (Fe)-chromium (Cr)-silicon (Si), or the like, but are not limited thereto. The resin mixture may include epoxy, polyimide, liquid crystal polymer (LCP), or the like, but is not limited thereto. The metal magnetic powders may be metal magnetic powders having at least two average particle sizes. In this case, bimodal metal magnetic powders having different sizes may be compressed and fully filled in the magnetic material-resin composite, such that a packing factor of the magnetic material-resin composite may be increased.

The coil portion 70 may perform various functions in the electronic device through a property appearing from a coil of the coil component 100. For example, the coil component 100 may be a high frequency inductor. In this case, the coil may be used as a noise filter in a signal terminal of a high frequency circuit. Alternatively, the coil component 100 may also be a power inductor. In this case, the coil may serve to store electricity in a magnetic field form to maintain an output voltage, resulting in stabilization of power. The first and second coil layers 31 and 32 disposed on opposite surfaces of the support member 20, respectively, may be electrically connected to each other through the via conductor 35 formed in a via hole **35*h* penetrating through the support member 20. Resultantly, the first and second coil layers 31 and 32 may be electrically connected to each other to form one coil. A detailed configuration for the coil portion 70** will be described below.

The electrode portion 80 may serve to electrically connect the coil component 100 and the electronic device to each other when the coil component 100 is mounted in the electronic device. The electrode portion 80 may include the first electrode 81 and the second electrode 82 disposed on the body portion 10 to be spaced apart from each other. The first electrode 81 may cover the first surface of the body portion 10 and extend to portions of the third surface, the fourth surface, the fifth surface, and the sixth surface of the body portion 10. The first electrode 81 may be connected to a terminal of the first coil layer 31 led to the first surface of the body portion 10. The second electrode 82 may cover the second surface of the body portion 10 and extend to portions of the third surface, the fourth surface, the fifth surface, and the sixth surface of the body portion 10. The second electrode 82 may be connected to a terminal of the second coil layer 32 led to the second surface of the body portion 10. However, the first and second electrodes 81 and 82 may be disposed in a form different from the form described above. The first and second electrodes 81 and 82 may include, for example, conductive resin layers and conductor layers formed on the conductive resin layers, respectively. The conductive resin layer may be formed by printing paste, and may include one or more conductive metals selected from the group consisting of copper (Cu), nickel (Ni), and silver (Ag), and a thermosetting resin. The conductor layer may include one or more selected from the group consisting of nickel (Ni), copper (Cu), and tin (Sn). For example, a nickel (Ni) layer and a tin (Sn) layer may be sequentially formed in the conductor layer by plating.

The electrode portion 80 may include a pre-plating layer (not illustrated) in order to improve electrical reliability between the coil portion 70 and the electrode portion 80, if necessary. The pre-plating layer (not illustrated) may include a first pre-plating layer (not illustrated) disposed on a terminal of the first coil layer 31 and connecting the terminal of the first coil layer 31 to the first electrode 81 and a second pre-plating layer (not illustrated) disposed on a terminal of the second coil layer 32 and connecting the terminal of the second coil layer 32 to the second electrode 82. The pre-plating layers may be formed by plating a conductive material such as copper (Cu). The electrodes 81 and 82 may be formed by applying at least one of nickel (Ni) and tin (Sn) to the pre-plating layers (not illustrated) or be formed by applying at least one of silver (Ag) and copper (Cu) to the pre-plating layers (not illustrated) and then applying at least one of nickel (Ni) and tin (Sn). Therefore, contact areas of the electrodes 81 and 82 may be increased, and silver (Ag), copper (Cu), and the like, for forming the electrodes 81 and 82 do not need to be separately applied.

Figure 3:
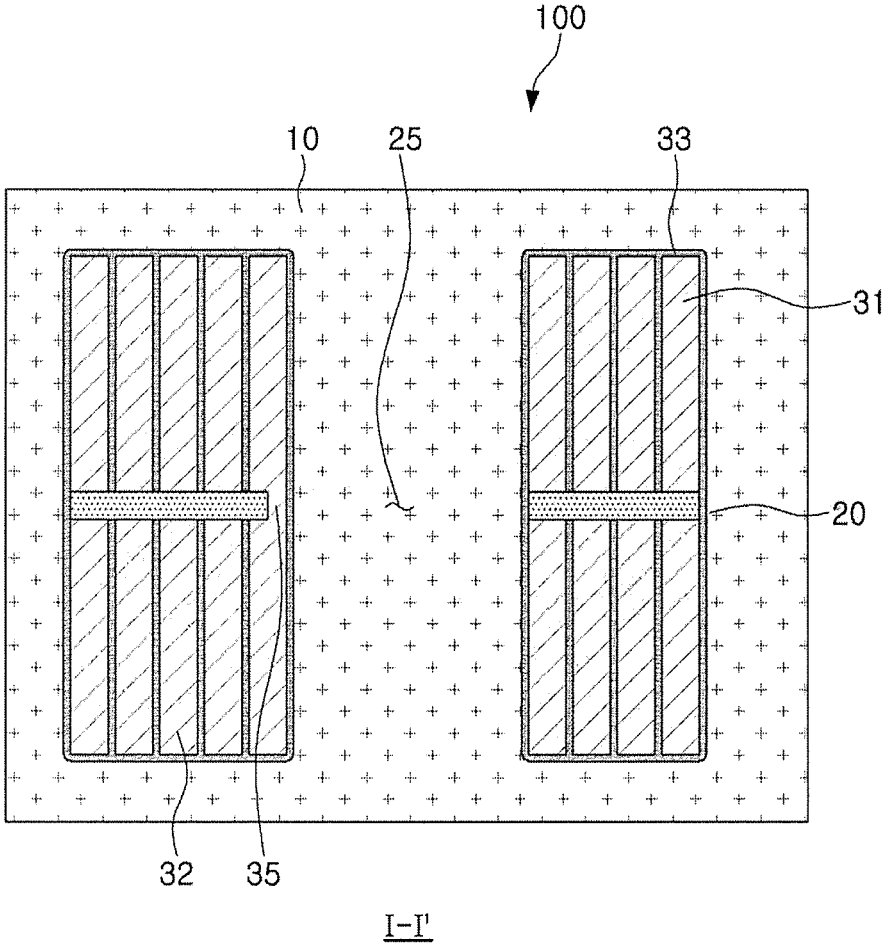
FIG. 3 is a schematic cross-sectional view taken along line I-I' of the coil component of FIG. 2.

FIG. 3 is a schematic cross-sectional view taken along line I-I' of the coil component of FIG. 2.

Referring to FIG. 3, the coil portion 70 may include the support member 20, the first coil layer 31 disposed on the upper surface of the support member 20 and having first conductive patterns having a planar coil shape, the second coil layer 32 disposed on the lower surface of the support member 20 and having second conductive patterns having a planar coil shape, the via conductor 35 formed in the via hole **35*h* penetrating through the support member 20 and electrically connecting the first and second coil layers 31 and 32 to each other, and an insulating film 33 filling spaces between the first conductive patterns of the first coil layer 31 and between the second conductive patterns of the second coil layer 32 and covering outer side surfaces of the first and second conductive patterns. The via hole 35*h* may partially overlap the innermost end portions of the first and second conductive patterns of the first and second coil layers 31 and 32, as described below, and the via conductor 35 may be formed along walls of the via hole 35*h* to fill a portion of the via hole 35*h*. The remaining portion of the via hole 35*h*** may be filled with the magnetic material.

The support member 20 may be an insulating substrate formed of an insulating resin. In this case, the insulating resin may be a thermosetting resin such as an epoxy resin, a thermoplastic resin such as a polyimide resin, a resin having a reinforcement material such as a glass fiber or an inorganic filler impregnated in the thermosetting resin and the thermoplastic resin, such as prepreg, Ajinomoto Build up Film (ABF), FR-4, a Bismaleimide Triazine (BT) resin, a photo-imagable dielectric (PID) resin, or the like. When the glass fiber is included in the support member 20, rigidity of the support member 20 may be more excellent. In some cases, a polypropylene glycol (PPG) substrate, a ferrite substrate, a metal soft magnetic substrate, or the like, may be used as the support member 20.

The first coil layer 31 may have the first conductive patterns having the planar coil shape. The first conductive pattern may be a plating pattern formed by a general plating method, but is not limited thereto. Since the first conductive pattern may have at least two turns, the first conductive pattern may be thin and implement a high inductance. The first conductive pattern may include a seed layer and a plating layer. The seed layer may include a plurality of layers. For example, the seed layer may include an adhesion layer including one or more of titanium (Ti), titanium-tungsten (Ti—W), molybdenum (Mo), chromium (Cr), nickel (Ni), and nickel-chromium (Ni—Cr), and a base plating layer disposed on the adhesion layer and including the same material as that of the plating layer, such as copper (Cu), but is not limited thereto. The plating layer may include a conductive material such as copper (Cu), aluminum (Al), silver (Ag), tin (Sn), gold (Au), nickel (Ni), lead (Pd) or alloys thereof, and may generally include copper (Cu), but is not limited thereto.

An aspect ratio of the first conductive pattern, which is a ratio of a height of the first conductive pattern to a width thereof, may be about 3 to 9. Direct current (DC) resistance (Rdc) characteristics, which are one of main characteristics of the coil component such as the inductor, may become low as a cross-sectional area of the coil becomes large. In addition, an inductance of the coil component may become large as an area of a magnetic region in the body portion through which a magnetic flux passes becomes large. Therefore, in order to decrease a DC resistance (Rdc) and increase the inductance, the cross-sectional area of the coil needs to be increased and the area of the magnetic region needs to be increased. As a method of increasing the cross-sectional area of the coil, there are a method of increasing a width of each of conductive patterns and a method of increasing a thickness of each of the conductive patterns. However, in a case of simply increasing the width of each of the conductive patterns, there is a risk that a short-circuit between the conductive patterns will occur. In addition, a limitation is generated in the turn of conductive patterns that may be implemented, and an area occupied by the magnetic region is decreased, such that efficiency of the inductor is decreased, and a limitation is also generated in implementing a high inductance product. On the other hand, when conductive patterns having a high aspect ratio are implemented by increasing a thickness of each of the conductive patterns without increasing a width of each of the conductive patterns, these problems may be solved. In addition, in the present disclosure, as described below, opening patterns are first formed in a resist and are utilized as plating growth guides, and a shape of each of conductive patterns may thus be easily controlled. However, when the aspect ratio of the first conductive pattern is excessively high, it may be difficult to implement the first conductive pattern, and a volume of a magnetic material disposed on the first conductive pattern may be decreased to have a negative influence on the inductance.

The second coil layer 32 may have the second conductive patterns having the planar coil shape. The second conductive pattern may be a plating pattern formed by a general plating method, but is not limited thereto. Since the second conductive pattern may have at least two turns, the second conductive pattern may be thin and implement a high inductance. The second conductive pattern may include a seed layer and a plating layer. The seed layer may include a plurality of layers. For example, the seed layer may include an adhesion layer including one or more of titanium (Ti), titanium-tungsten (Ti—W), molybdenum (Mo), chromium (Cr), nickel (Ni), and nickel-chromium (Ni—Cr), and a base plating layer disposed on the adhesion layer and including the same material as that of the plating layer, such as copper (Cu), but is not limited thereto. The plating layer may include a conductive material such as copper (Cu), aluminum (Al), silver (Ag), tin (Sn), gold (Au), nickel (Ni), lead (Pd), or alloys thereof, and may generally include copper (Cu), but is not limited thereto.

An aspect ratio of the second conductive pattern, which is a ratio of a height of the second conductive pattern to a width thereof, may be about 3 to 9. DC resistance (Rdc) characteristics, which are one of main characteristics of the coil component such as the inductor, may become low as a cross-sectional area of the coil becomes large. In addition, an inductance of the coil component may become large as an area of a magnetic region in the body portion through which a magnetic flux passes becomes large. Therefore, in order to decrease a DC resistance (Rdc) and increase the inductance, the cross-sectional area of the coil needs to be increased and the area of the magnetic region needs to be increased. As a method of increasing the cross-sectional area of the coil, there are a method of increasing a width of each of conductive patterns and a method of increasing a thickness of each of the conductive patterns. However, in a case of simply increasing the width of each of the conductive patterns, there is a risk that a short-circuit between the conductive patterns will occur. In addition, a limitation is generated in the turn of conductive patterns that may be implemented, and an area occupied by the magnetic region is decreased, such that efficiency of the inductor is decreased, and a limitation is also generated in implementing a high inductance product. On the other hand, when conductive patterns having a high aspect ratio are implemented by increasing a thickness of each of the conductive patterns without increasing a width of each of the conductive patterns, these problems may be solved. In addition, in the present disclosure, as described below, opening patterns are first formed in a resist and are utilized as plating growth guides, and a shape of each of conductive patterns may thus be easily controlled. However, when the aspect ratio of the second conductive pattern is excessively high, it may be difficult to implement the second conductive pattern, and a volume of a magnetic material disposed on the second conductive pattern may be decreased to have a negative influence on the inductance.

The insulating film 33 may fill the spaces between the first conductive patterns and between the second conductive patterns, and cover the outer side surfaces of the first and second conductive patterns. The insulating film 33 may also cover an outer side surface of the via conductor 35. The insulating film 33 may include an insulating material for general insulation coating, such as an epoxy resin, a polyimide resin, a liquid crystalline polymer resin, or the like, but is not limited thereto. Side surfaces of the first and second conductive patterns of the first and second coil layers 31 and 32 in contact with the insulating film 33 may be flat. Upper and lower surfaces of the first and second conductive patterns of the first and second coil layers 31 and 32 in contact with the insulating film 33 may be flat. That is, since the first and second conductive patterns of the first and second coil layers 31 and 32 may be formed using partition walls 61 and 62 as described below, the side surfaces and the upper and lower surfaces of the first and second conductive patterns may be flow, such that the first and second conductive patterns may stably have high aspect ratios. Here, a term "flat" conceptually includes "substantially flat" as well as "completely flat".

The via conductor 35 may electrically connect the first coil layer 31 and the second coil layer 32 to each other to form one coil rotated in the same direction. The via conductor 35 may be formed along the walls of the via hole **35*h* penetrating through the support member 20 by plating. The first and second conductive patterns of the first and second coil layers 31 and 32 and the via conductor 35 may be simultaneously formed, and be thus integrated with each other. The via conductor 35 may also include a via seed layer and a via plating layer. The via seed layer may include a plurality of layers. For example, the via seed layer may include a via adhesion layer including one or more of titanium (Ti), titanium-tungsten (Ti—W), molybdenum (Mo), chromium (Cr), nickel (Ni), and nickel-chromium (Ni—Cr), and a via base plating layer disposed on the via adhesion layer and including the same material as that of the via plating layer, such as copper (Cu), but is not limited thereto. The via plating layer may include a conductive material such as copper (Cu), aluminum (Al), silver (Ag), tin (Sn), gold (Au), nickel (Ni), lead (Pd), or alloys thereof, and may generally include copper (Cu), but is not limited thereto. The via hole 35***h* may have a circular or oval planar shape of which at least a portion is removed. The reason is that a planar shape of the via hole 35*h* is circular or oval as described below, but at least a portion of the via hole 35*h* is also removed when a through-hole is formed in a trimming process.

Figure 4A:
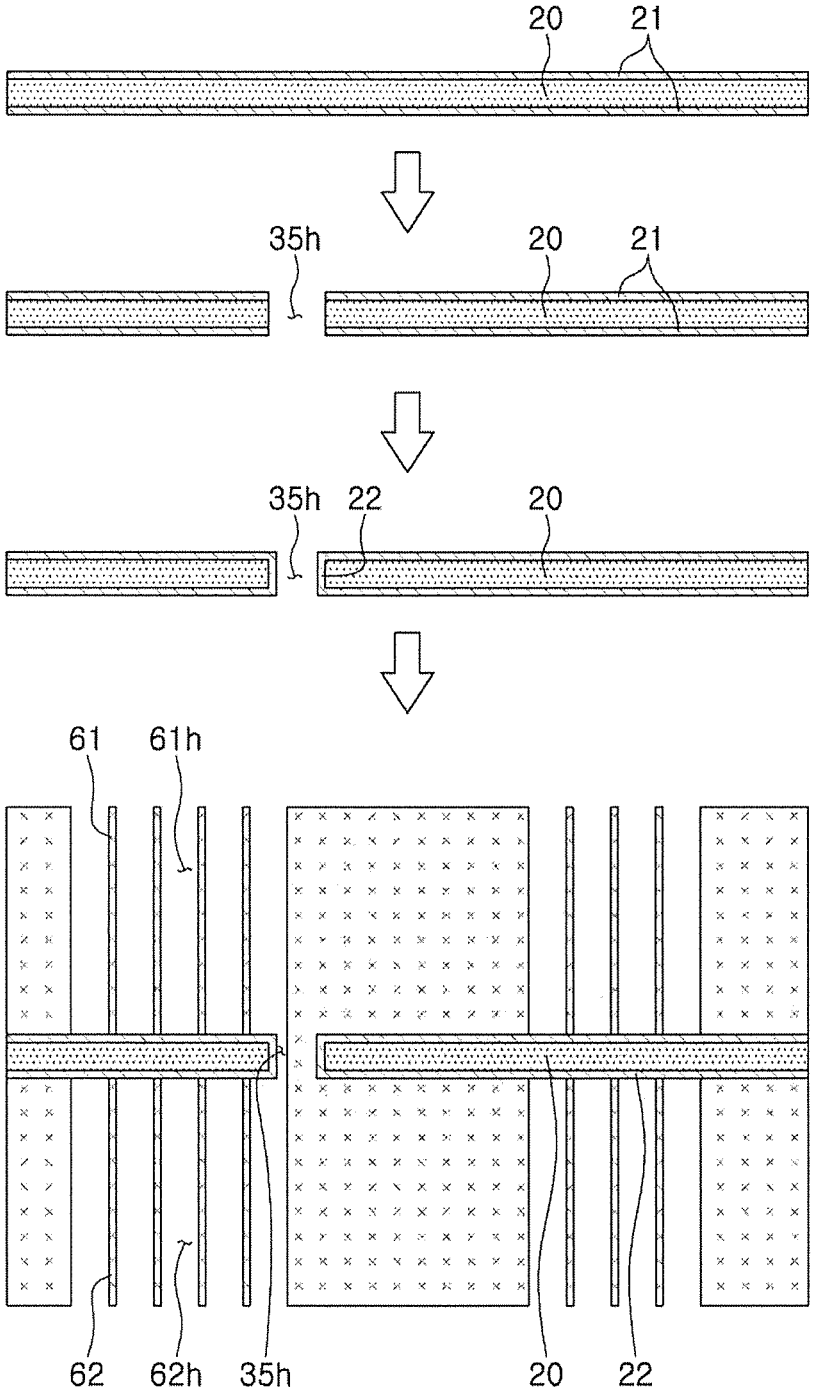
FIGS. 4A and 4B are schematic views illustrating manufacturing processes of the coil component of FIG. 2.
Figure 4B:
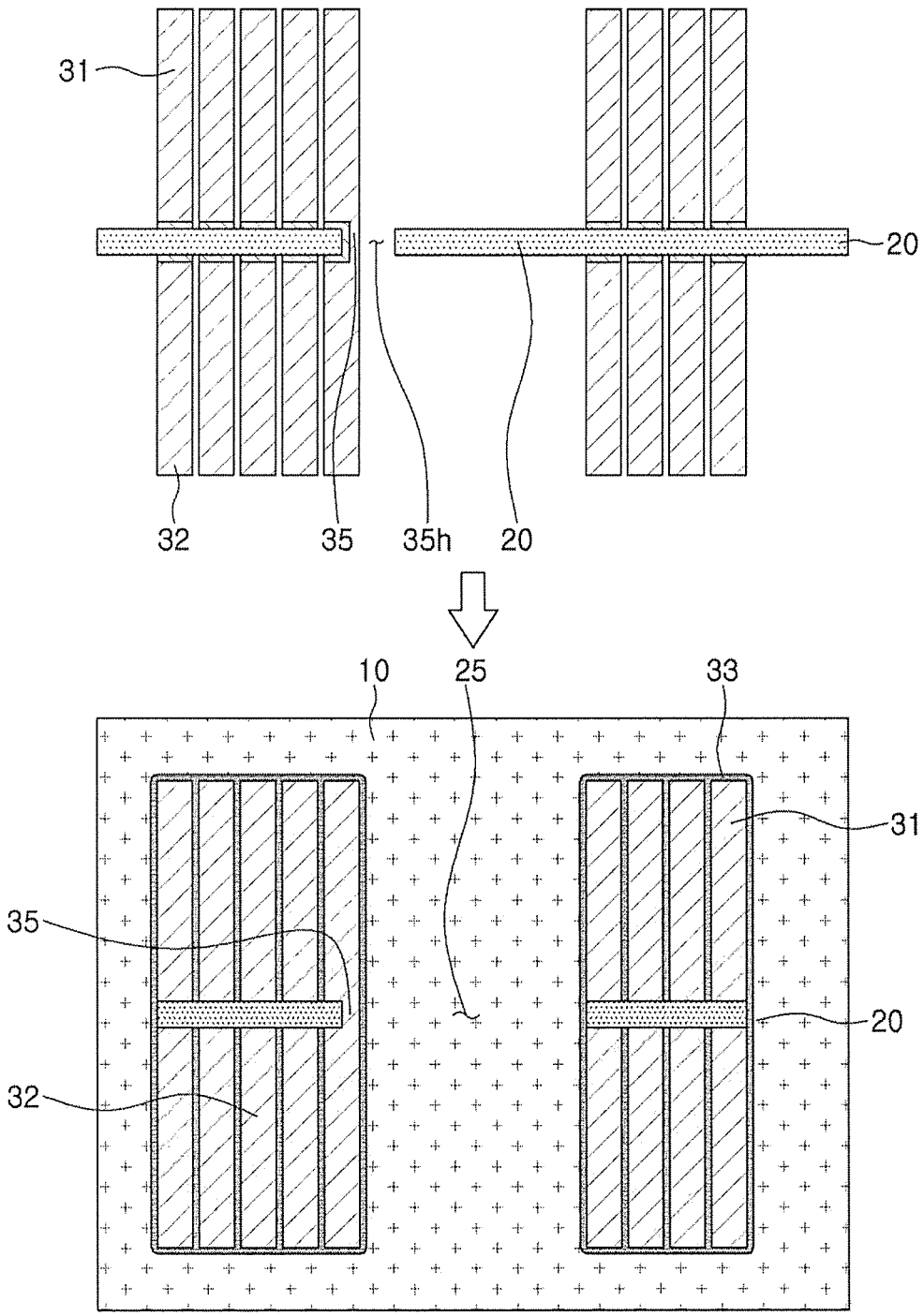

FIGS. 4A and 4B are schematic views illustrating processes of manufacturing the coil component of FIG. 2.

Referring to FIG. 4A, the support member 20 may be first prepared. The support member 20 may be a general copper clad laminate (CCL). In this case, thin copper foils 21 may be formed on upper and lower surfaces of the support member 20. Then, the via hole 35*h* may be formed in the support member 20. The via hole 35*h* may be formed using a mechanical drill and/or a laser drill. Then, a seed layer 22 may be formed on the upper and lower surfaces of the support member 20 and walls of the via hole 35*h*. The seed layer may be formed by any known method such as chemical vapor deposition (CVD), physical vapor deposition (PVD), sputtering, or the like, using a dry film, or the like, but is not limited thereto. Then, first partition walls 61 and second partition walls 62 may be formed on the upper and lower surfaces of the support member 20, respectively. Each of the first and second partition walls 61 and 62 may be a resist film, and may be formed by a method of laminating and hardening the resist film, a method of applying and hardening a material of the resist film, or the like, but is not limited thereto. As the method of laminating the resist film, for example, a method of performing a hot press process of pressing the resist film for a predetermined time at a high temperature, decompressing the resist film, and then cooling the resist film to room temperature, cooling the resist film in a cold press process, and then separating a work tool, or the like, may be used. As a method of applying the material of the resist film, for example, a screen printing method of applying ink with a squeegee, a spray printing method of applying ink in a mist form, or the like, may be used. The hardening process, which is a post-process, may be a process of drying the material so as to not be completely hardened in order to use a photolithography method, or the like. The first and second partition walls 61 and 62 may have first and second openings 61*h* and 62*h* having planar coil shapes, respectively, and the first and second openings 61*h* and 62*h* may be formed by any known photolithography method, that is, any known exposing and developing method, and may be sequentially patterned or be patterned at a time. An exposing machine or a developing solution is not particularly limited, but may be appropriately selected and used depending on a used photosensitive material.

Then, referring to FIG. 4B, the first and second coil layers 31 and 32 and the via conductor 35 may be formed on the seed layer 22 utilizing the openings 61*h* and 62*h* of the first and second partition walls 61 and 62 as plating growth guides. As described above, after opening patterns are formed in an insulator, plating is performed utilizing the opening patterns as guides, and a shape of each of conductive patterns may thus be easily controlled unlike anisotropic plating technology according to the related art. That is, side surfaces of the first and second conductive patterns in contact with the first and second partition walls 61 and 62 may be flat. Here, a term "flat" conceptually includes "substantially flat" as well as "completely flat". That is, it is considered that walls of the opening patterns are partially uneven due to the photolithography method. A plating method is not particularly limited. That is, the plating method may be electroplating, electroless plating, or the like, but is not limited thereto. After the first and second coil layers 31 and 32 and the via conductor 35 are formed, the first and second partition walls 61 and 62 may be removed. The first and second partition walls 61 and 62 may be removed using any known stripping solution. Meanwhile, a diameter of the via hole 35*h* in which the via conductor 35 may be equal to or greater than a line width of each of the first and second conductive patterns, and the via hole 35*h* may be misaligned with the innermost end portions of the first and second conductive patterns. The via hole 35*h* may have a space filled with the magnetic material. Then, a through-hole 25 penetrating through the support member 20 may be formed by a trimming process. The through-hole 25 may be formed using a laser drill, a mechanical drill, or the like. The through-hole 25 may be connected to the via hole 35*h* to form one hole. In the trimming process, through-holes may be formed in an outer side portion of the support member 20 as well as in a central portion of the support member. That is, in the trimming process, the through-holes may be formed in the central portion and the outer side portion of the support member 20 so that the support member 20 has a shape corresponding to planar shapes of the first and second conductive patterns of the first and second coil layers 31 and 32. The through-holes may be filled with the magnetic material, and more excellent coil characteristics may thus be implemented. Then, the insulating film 35 may be formed. The insulating layer 33 may be coated by chemical vapor deposition (CVD), or the like. Then, the body portion 10 may be formed by stacking magnetic sheets on upper and lower surfaces of the manufactured coil portion 70, and the electrode portion 80 may be formed on the formed body portion 10.

Figure 5:
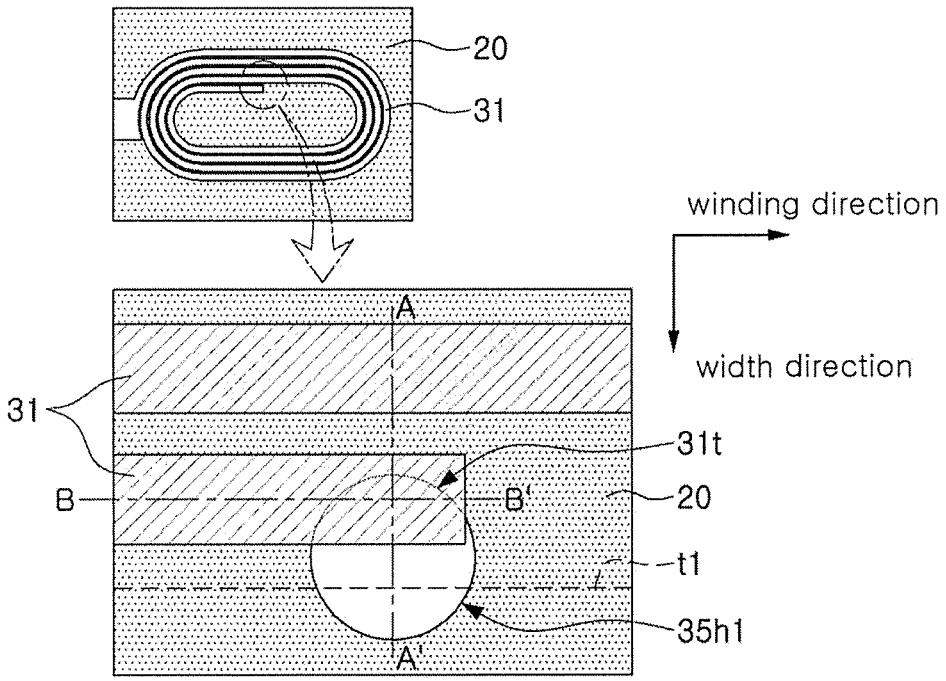
FIG. 5 is a schematic plan view illustrating an example of a coil portion before a trimming process of the coil component of FIG. 2.

FIG. 5 is a schematic plan view illustrating an example of a coil portion before a trimming process of the coil component of FIG. 2.

Figure 6:
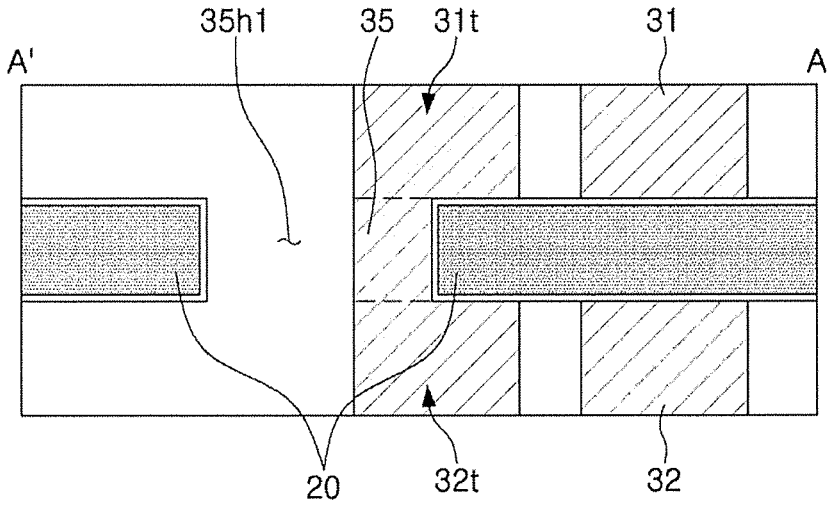
FIG. 6 is a schematic cross-sectional view taken along line A-A' of the coil portion of FIG. 5.

FIG. 6 is a schematic cross-sectional view taken along line A-A' of the coil portion of FIG. 5.

Figure 7:
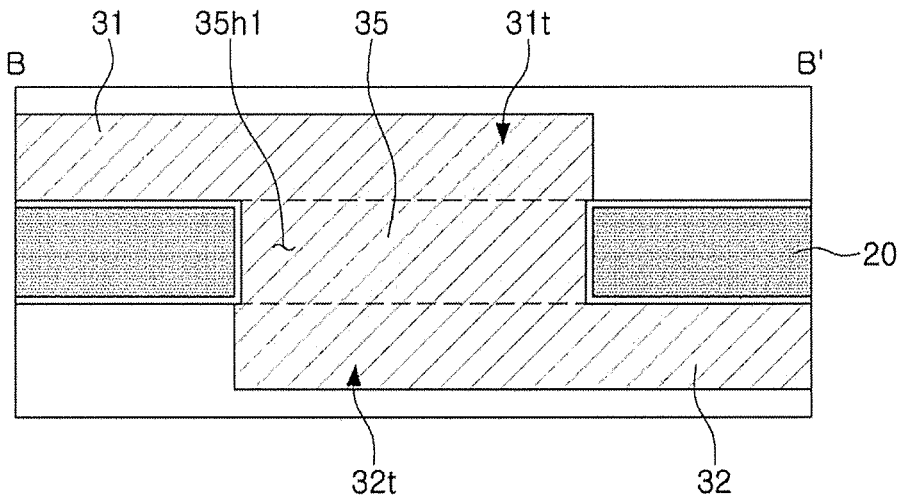
FIG. 7 is a schematic cross-sectional view taken along line B-B' of the coil portion of FIG. 5.

FIG. 7 is a schematic cross-sectional view taken along line B-B' of the coil portion of FIG. 5.

Referring to FIGS. 5 through 7, the innermost end portions 31*t* and 32*t* of the first and second conductive patterns of the first and second coil layers 31 and 32 connected to the via conductor 35 may have a line width that is substantially the same as that of the innermost patterns of the first and second conductive patterns. That is, each of the first and second conductive patterns may have a constant line width up to the innermost end portion. Herein, a phrase "substantially the same" conceptually includes a case in which line widths have a very fine difference such as a difference of 1/10 or less of a designed line width therebetween due to a limitation in a process as well as a case in which line widths are completely the same as each other. Herein, a term "constant" conceptually includes a case in which a line width has a very fine difference such as a difference of 1/10 or less of a designed line width due to a limitation in a process as well as a case in which a line width is completely constant. That is, the first and second conductive patterns of the first and second coil layers 31 and 32 may not have via pads at the end portions thereof. When the via pads exist, overplating may occur due to the via pads greater than the line widths of the conductive patterns, such that a plating dispersion may be increased. However, when the via pads are omitted as described above, a problem such as the overplating may be suppressed, and uniformity of a plating thickness may be secured.

In addition, a via hole 35*h*1 may have a spherical shape and may partially overlap the innermost end portions 31*t* and 32*t* of the first and second conductive patterns, the largest diameter of diameters of the via hole 35*h*1 passing through any two points of an edge of the via hole 35*h*1 and the center of the via hole 35*h*1 may be greater than the line width of each of the first and second conductive patterns, and the shortest diameter of the diameters of the via hole 35*h*1 passing through any two points of the edge of the via hole 35*h*1 and the center of the via hole 35*h*1 may be equal to or greater than the line width of each of the first and second conductive patterns. That is, any diameter of the via hole 35*h*1 may be equal to or greater than the line width of each of the first and second conductive patterns. Since the via conductor 35 is formed along walls of the via hole 35*h*1 and is connected to the end portions 31*t* and 32*t* of the first and second conductive patterns, contact areas between the conductive patterns and the via conductor 35 may be increased to improve reliability for electrical conduction between layers, and electrical conduction areas between the layers may be increased to increase a current path. Therefore, a DC resistance (Rdc) may be decreased to improve coil characteristics.

Meanwhile, the via hole 35*h*1 may be disposed to be misaligned with the end portions 31*t* and 32*t* of the first and second conductive patterns so as to partially overlap the end portions 31*t* and 32*t* of the first and second conductive patterns, and the via conductor 35 may be formed along the walls of the via hole 35*h*1 to fill only a portion of the via hole 35*h*1. At least a portion of the remaining space of the via hole 35*h*1 may be filled with the magnetic material constituting the body portion 10. When the trimming process is performed, the through-hole 25 penetrating through the support member 20 may be formed along a trimming line t1. In this case, the via hole 35*h*1 may have a trimmed spherical shape, and may be integrated with the through-hole 25 to form one hole.

Figure 8:
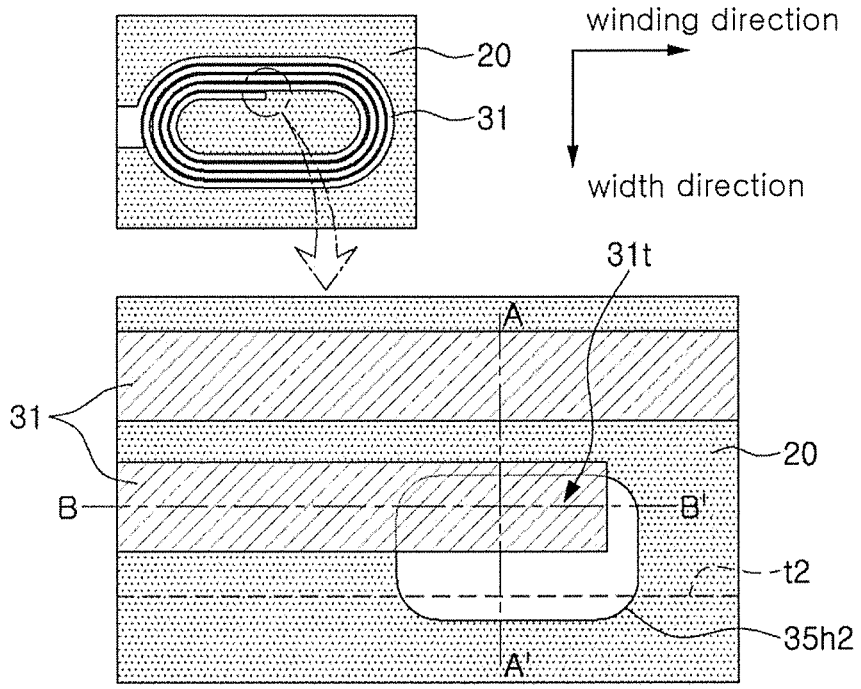
FIG. 8 is a schematic plan view illustrating another example of a coil portion before a trimming process of the coil component of FIG. 2.

FIG. 8 is a schematic plan view illustrating another example of a coil portion before a trimming process of the coil component of FIG. 2.

Figure 9:
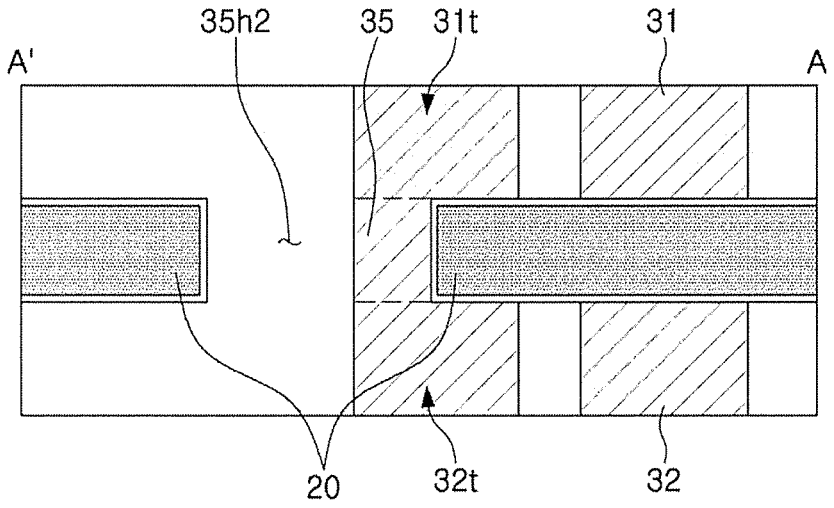
FIG. 9 is a schematic cross-sectional view taken along line A-A' of the coil portion of FIG. 8.

FIG. 9 is a schematic cross-sectional view taken along line A-A' of the coil portion of FIG. 8.

Figure 10:
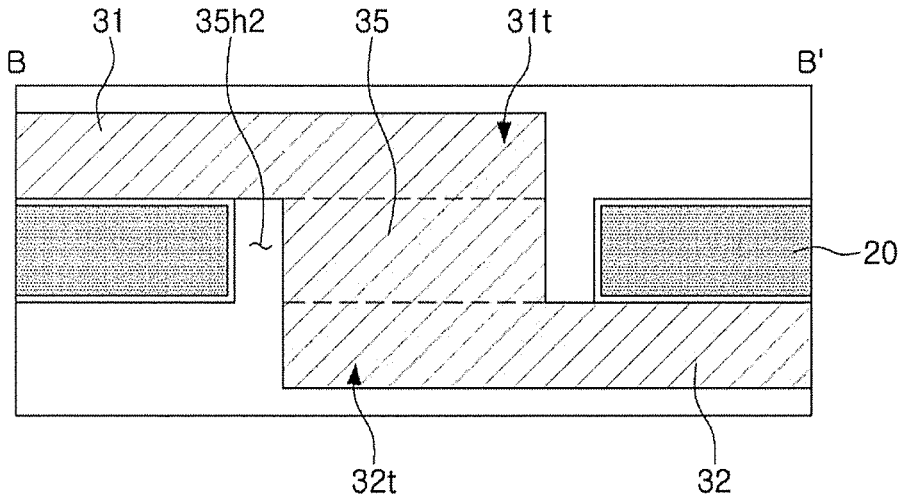
FIG. 10 is a schematic cross-sectional view taken along line B-B' of the coil portion of FIG. 8.

FIG. 10 is a schematic cross-sectional view taken along line B-B' of the coil portion of FIG. 8.

Referring to FIGS. 8 through 10, a via hole 35*h*2 may have an oval shape. In this case, a contact area between the first and second conductive patterns may be increased as compared to the via hole 35*h*1 having the spherical shape. Likewise, end portions 31*t* and 32*t* of the first and second conductive patterns of the first and second coil layers 31 and 32 connected to the via conductor 35 may have a line width that is substantially the same as that of the innermost patterns of the first and second conductive patterns. That is, the first and second conductive patterns of the first and second coil layers 31 and 32 may not have via pads. In addition, the via hole 35*h*2 may partially overlap the innermost end portions 31*t* and 32*t* of the first and second conductive patterns, the largest diameter of diameters of the via hole 35*h*2 passing through any two points of an edge of the via hole 35*h*2 and the center of the via hole 35*h*2 may be greater than the line width of each of the first and second conductive patterns, and the shortest diameter of the diameters of via hole 35*h*2 passing through any two points of the edge of the via hole 35*h*2 and the center of the via hole 35*h*2 may be equal to or greater than the line width of each of the first and second conductive patterns. That is, any diameter of the via hole 35*h*2 may be equal to or greater than the line width of each of the first and second conductive patterns. The via conductor 35 may be formed along walls of the via hole 35*h*2 and be connected to the end portions 31*t* and 32*t* of the first and second conductive patterns. The via hole 35*h*2 may be disposed to be misaligned with the end portions 31*t* and 32*t* of the first and second conductive patterns so as to partially overlap the end portions 31*t* and 32*t* of the first and second conductive patterns, and the via conductor 35 may be formed along the walls of the via hole 35*h*2 to fill only a portion of the via hole 35*h*2. The remaining space of the via hole 35*h*2 may be filled with the magnetic material constituting the body portion 10. When the trimming process is performed, the through-hole 25 penetrating through the support member 20 may be formed along a trimming line t2. In this case, the via hole 35*h*2 may have a trimmed oval shape, and may be integrated with the through-hole 25 to form one hole.

The via conductor 35 may have a first width in a winding direction of the innermost end portions 31*t* and 32*t* of the first and second conductive patterns, and a second width in a width direction perpendicular to the winding direction and the stacking direction. The first width may be greater than the second width.

The via hole 35*h*2 may have a first width in a winding direction of the innermost end portions 31*t* and 32*t* of the first and second conductive patterns, and a second width in a width direction perpendicular to the winding direction and the stacking direction. The first width may be greater than the second width. The first width may be greater than the second width.

Figure 11:
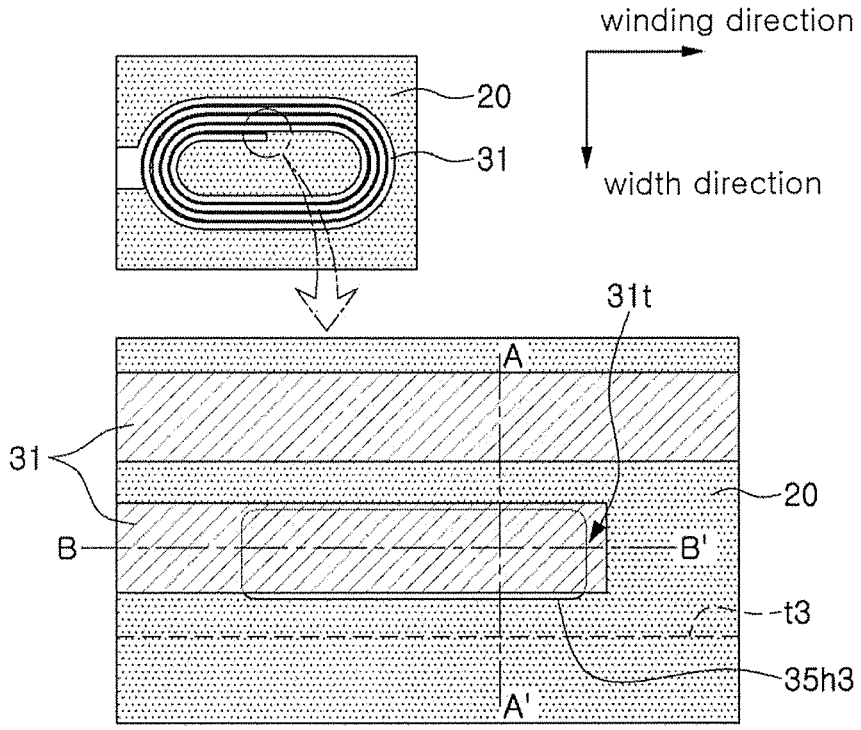
FIG. 11 is a schematic plan view illustrating another example of a coil portion before a trimming process of the coil component of FIG. 2.

FIG. 11 is a schematic plan view illustrating another example of a coil portion before a trimming process of the coil component of FIG. 2.

Figure 12:
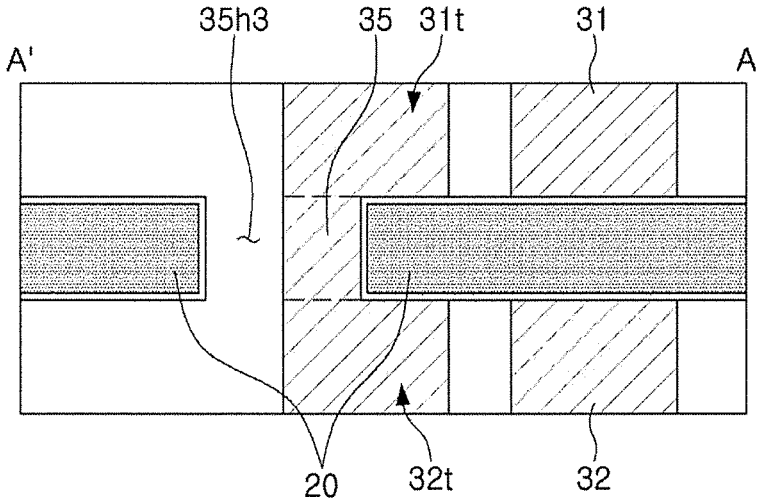
FIG. 12 is a schematic cross-sectional view taken along line A-A' of the coil portion of FIG. 11.

FIG. 12 is a schematic cross-sectional view taken along line A-A' of the coil portion of FIG. 11.

Figure 13:
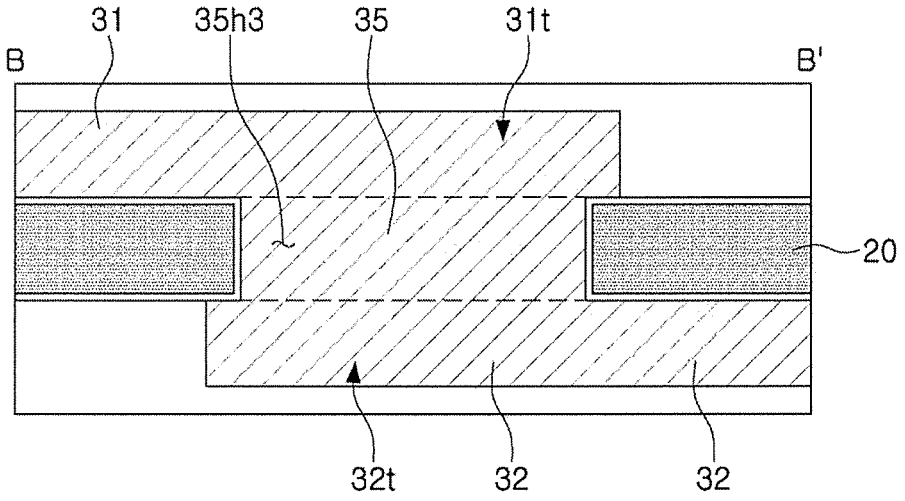
FIG. 13 is a schematic cross-sectional view taken along line B-B' of the coil portion of FIG. 11.

FIG. 13 is a schematic cross-sectional view taken along line B-B' of the coil portion of FIG. 11.

Referring to FIGS. 11 through 13, a contact area between the first and second conductive patterns may further be increased by increasing a length of a via hole 35*h*3 instead of decreasing a width of the via hole 35*h*3. Likewise, end portions 31*t* and 32*t* of the first and second conductive patterns of the first and second coil layers 31 and 32 connected to the via conductor 35 may have a line width that is substantially the same as that of the innermost patterns of the first and second conductive patterns. That is, the first and second conductive patterns of the first and second coil layers 31 and 32 may not have via pads. In addition, the via hole 35*h*3 may partially overlap the innermost end portions 31*t* and 32*t* of the first and second conductive patterns, the largest diameter of diameters of the via hole 35*h*3 passing through any two points of an edge of the via hole 35*h*3 and the center of the via hole 35*h*3 may be greater than the line width of each of the first and second conductive patterns, and the shortest diameter of the diameters of via hole 35*h*3 passing through any two points of the edge of the via hole 35*h*3 and the center of the via hole 35*h*3 may be equal to or greater than the line width of each of the first and second conductive patterns. That is, any diameter of the via hole 35*h*3 may be equal to or greater than the line width of each of the first and second conductive patterns. The via conductor 35 may be formed along walls of the via hole 35*h*3 and be connected to the end portions 31*t* and 32*t* of the first and second conductive patterns. The via hole 35*h*3 may be disposed to be misaligned with the end portions 31*t* and 32*t* of the first and second conductive patterns so as to partially overlap the end portions 31*t* and 32*t* of the first and second conductive patterns, and the via conductor 35 may be formed along the walls of the via hole 35*h*3 to fill only a portion of the via hole 35*h*3. The remaining space of the via hole 35*h*3 may be filled with the magnetic material constituting the body portion 10. Meanwhile, the via hole 35*h*3 may not be connected to the through-hole 25 depending on how a trimming line t3 is formed. That is, the via hole 35*h*3 and the through-hole 25 may exist in independent hole forms, respectively.

The via conductor 35 may have a first width in a winding direction of the innermost end portions 31*t* and 32*t* of the first and second conductive patterns, and a second width in a width direction perpendicular to the winding direction and the stacking direction. The first width may be greater than the second width.

The via hole 35*h*3 may have a first width in a winding direction of the innermost end portions 31*t* and 32*t* of the first and second conductive patterns, and a second width in a width direction perpendicular to the winding direction and the stacking direction. The first width may be greater than the second width. The first width may be greater than the second width.

As set forth above, according to the exemplary embodiments in the present disclosure, a coil component in which a plating thickness dispersion may be suppressed and uniformity of a plating thickness may be secured by preventing overplating, and DC resistance characteristics (Rdc) may be improved by increasing contact areas between a via conductor and conductive patterns, and a method of manufacturing the same may be provided.

While exemplary embodiments have been shown and described above, it will be apparent to those skilled in the art that modifications and variations could be made without departing from the scope of the present invention as defined by the appended claims.

What is claimed is:

1. A coil component comprising:

a body portion including a magnetic material;

a coil portion disposed in the body portion; and an electrode portion disposed on the body portion and electrically connected to the coil portion, wherein the coil portion includes:

a support member;

a first coil layer disposed on a first surface of the support member in a stacking direction, having first conductive patterns having a planar coil shape;

a second coil layer disposed on a second surface of the support member in the stacking direction, having second conductive patterns having a planar coil shape;

a via hole penetrating through the support member and partially overlapping innermost end portions of the first and second conductive patterns; and a via conductor filling a portion of the via hole and connecting the innermost end portions of the first and second conductive patterns to each other, wherein at least a portion of the via hole is filled with the magnetic material, wherein thicknesses of said innermost end portions in the stacking direction are substantially equal to thicknesses of portions of the first and second conductive patterns excluding said innermost end portions, respectively, and wherein a width of the via hole is greater than or equal to a width of the first conductive patterns and a width of the second conductive patterns.

2. The coil component of claim 1, wherein the via hole has a circular or oval planar shape of which at least a portion is removed.

3. The coil component of claim 1, wherein a through-hole penetrating through the support member is formed in a central portion of the support member.

4. The coil component of claim 3, wherein the through-hole is filled with the magnetic material.

5. The coil component of claim 3, wherein the through-hole is integrated with the via hole to form one hole.

6. The coil component of claim 1, wherein the coil portion further includes an insulating film filling spaces between each coil turn of the first conductive patterns and between each coil turn of the second conductive patterns, and covering outer side surfaces of the first and second conductive patterns.

7. The coil component of claim 6, wherein side surfaces of the first and second coil layers in contact with the insulating film are substantially flat.

8. The coil component of claim 6, wherein upper and lower surfaces of the first and second coil conductors in contact with the insulating film are substantially flat.

9. The coil component of claim 1, wherein a first width of the via conductor in a winding direction of the innermost end portions of the first and second conductive patterns is greater than a second width of the via conductor in a width direction perpendicular to the winding direction and the stacking direction.

10. The coil component of claim 1, wherein a first width of the via hole in a winding direction of the innermost end portions of the first and second conductive patterns is greater than a second width of the via hole in a width direction perpendicular to the winding direction and the stacking direction.

11. The coil component of claim 1, wherein the first and second coil layers have a constant line width up to the innermost end portions of the first and second conductive patterns.

12. The coil component of claim 1, wherein, in a view from the stacking direction, a cross-sectional area of the via conductor is substantially equal to an overlapping area between the via hole and said innermost end portions.

13. A coil component comprising:

a body portion including a magnetic material;

a coil portion disposed in the body portion; and an electrode portion disposed on the body portion and electrically connected to the coil portion, wherein the coil portion includes:

a support member;

a first coil layer disposed on a first surface of the support member in a stacking direction, having first conductive patterns having a planar coil shape;

a second coil layer disposed on a second surface of the support member in the stacking direction, having second conductive patterns having a planar coil shape;

a via hole penetrating through the support member and partially overlapping innermost end portions of the first and second conductive patterns; and a via conductor filling a portion of the via hole and connecting the innermost end portions of the first and second conductive patterns to each other, wherein widths of said innermost end portions that partially overlap the via hole in a width direction are substantially equal to widths of portions of the first and second conductive patterns excluding said innermost end portions, respectively, and wherein a width of the via hole is greater than or equal to a width of the first conductive patterns and a width of the second conductive patterns.

* * * * *